US005278616A

United States Patent [19]

Hirano et al.

[11] Patent Number: 5,278,616

[45] Date of Patent: Jan. 11, 1994

[54] DEVELOPING DEVICE FOR AN IMAGE FORMING APPARATUS

[75] Inventors: Kouji Hirano, Kanagawa; Minoru Yoshida, Tokyo, both of Japan

[73] Assignee: Kabushiki Kaisha Toshiba, Kawasaki, Japan

[21] Appl. No.: 904,495

[22] Filed: Jun. 25, 1992

[30] Foreign Application Priority Data

Jun. 28, 1991 [JP] Japan ..... 3-158875

[51] Int. Cl.[5] ..... G03G 15/08

[52] U.S. Cl. ..... 355/259; 355/245

[58] Field of Search ..... 355/245, 259; 118/651, 118/653, 661

[56] References Cited

U.S. PATENT DOCUMENTS

| | | | |
|---|---|---|---|
| 4,026,648 | 5/1977 | Takahashi | 355/299 |
| 4,465,362 | 8/1984 | Tohma et al. | 355/299 |
| 4,967,231 | 10/1990 | Hosoya et al. | 355/219 |
| 4,967,731 | 11/1990 | Terhune | 126/544 |
| 5,095,341 | 3/1992 | Yoshida et al. | 355/259 |
| 5,097,294 | 3/1992 | Nishio et al. | 355/245 |

FOREIGN PATENT DOCUMENTS

| | | |
|---|---|---|
| 1-140565 | 9/1989 | Japan . |
| 2-39175 | 2/1990 | Japan . |

*Primary Examiner*—Fred L. Braun

*Attorney, Agent, or Firm*—Banner, Birch, McKie & Beckett

[57] ABSTRACT

An image forming apparatus includes a developing device for developing a latent image formed on an image bearing member. The developing device has a developing roller for supplying a developing agent to the image bearing member and a blade for forming a layer of the developing agent on the developing roller. The developing roller has an elastic layer for obtaining a predetermined nip width between the developing roller and the image bearing member. The blade has a plate member, a contact member attached in the longitudinal direction along the loading edge of the plate member for contacting the surface of the developing roller so as to form the layer of the developing agent, a pressing member for pressing the contact member to the developing roller and a control member attached on the plate member and positioned to each end of the contact member for controlling the amount of the contact pressure of the contact member to the developing roller. An optical device measures the amount of distortion of the surface of the developing roller when the roller is in contact with the contact member and the roller is rotated at a predetermined angle of rotation when the distortion exceeds a predetermined value. Thereby, the developing device of of the present invention is capable of obtaining high-quality images when the developing device is used or set in the image forming apparatus over a long period of time.

7 Claims, 5 Drawing Sheets

DEVELOPING DEVICE FOR AN IMAGE FORMING APPARATUS

BACKGROUND OF THE INVENTION

1. Field of the Invention

The present invention generally relates to a device for developing latent images in an image forming apparatus, such as a photocopy machine or laser printer. More particularly, the invention relates to a developing device which is capable of achieving a high-quality finished image using a one-component developing agent.

2. Description of the Related Art

U.S. Pat. No. 4,967,231 discloses an apparatus for forming an electro-photographic latent image. The apparatus employs an impression developing method which uses a one-component developing agent. Such a method requires the use of an elastic developing roller which has electrical conductivity. In the image forming process, the developing roller is maintained in contact with an image bearing member, such as a photosensitive body, and a blade for forming a thin toner layer on the developing roller. In addition, the frictional charge of the toner is effected by the friction created when the developing roller makes contact with a predetermined nip width with the blade.

Since the developing roller has elasticity in this developing method, the surface of the developing roller is distorted by the pressure contact of the blade. Particularly, the distortion of the surface of the developing roller increases when the developing roller stops. However, a certain length of time is required for the full recovery of the developing roller which has been distorted by the pressure contact of the blade. Thus, the developing operation may be performed before full recovery from the distortion of the surface of the developing roller. The distortion of the surface of the developing roller, thus, results in a poor reproduction of the image.

SUMMARY OF THE INVENTION

It is an object of the present invention to provide a developing device which is capable of obtaining a high-quality image, wherein the image quality is not deteriorated even when the developing device is used or set in an image forming apparatus for a long period of time.

Accordingly, the foregoing objective, as well as others, are achieved by the present invention which provides a developing device for developing a latent image formed on an image bearing member in an image forming apparatus. The developing device comprises a roller for supplying a developing agent to the image bearing member and means for forming a layer of the developing agent on the roller. The roller has an elastic member for obtaining a predetermined nip width between the roller and the image bearing member. The means for forming a layer of the developing agent on the roller includes a contact member for contacting the surface of the roller so as to form the layer of the developing agent, a device for pressing the contact member to the roller and a control member positioned to each end of the contact member for controlling the amount of the contact pressure of the contacting member to the roller.

A further feature of the present invention provides a developing device for developing a latent image formed on an image bearing member in an image forming apparatus. The developing device comprises a roller having an elastic member for providing a predetermined nip width between the roller and the image bearing member for supplying a developing agent to the image bearing member and a forming device for forming a layer of the developing agent on the roller. The forming device has a contact member for contacting the forming device to the roller. The developing device also has a measuring device for measuring the amount of the distortion of the surface of the roller with which the contact member is brought into contact and a rotating device for rotating the roller at a predetermined rotational angle when the amount of the distortion measured by the measuring device reaches a predetermined value.

In accordance with another feature of the present invention, the above stated objects are achieved by providing an image forming apparatus comprising a latent image forming device for forming a latent image on an image bearing member and a developing roller for supplying a one-component non-magnetic developing agent to the image bearing member so as to develop the latent image formed on the image bearing member. The developing roller has an elastic layer for obtaining a predetermined nip width between the developing roller and the image bearing member and a conductive layer deposited on the elastic layer. The image forming apparatus also includes a blade for forming a layer of the one-component non-magnetic developing agent on the developing roller. The blade has a plate member, an elastic tip member attached in the longitudinal direction along the leading edge of the plate member for contacting the surface of the developing roller so as to form the layer of developing agent, a pressing member for pressing the elastic tip member to the developing roller and an elastic control member attached to the plate member and positioned to each end of the tip member for controlling the amount of the contact pressure of the tip member to the developing roller. The height of the elastic control member is lower than the height of the tip member. The hardness of the elastic control member also is equal to or harder than the hardness of the elastic tip member.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
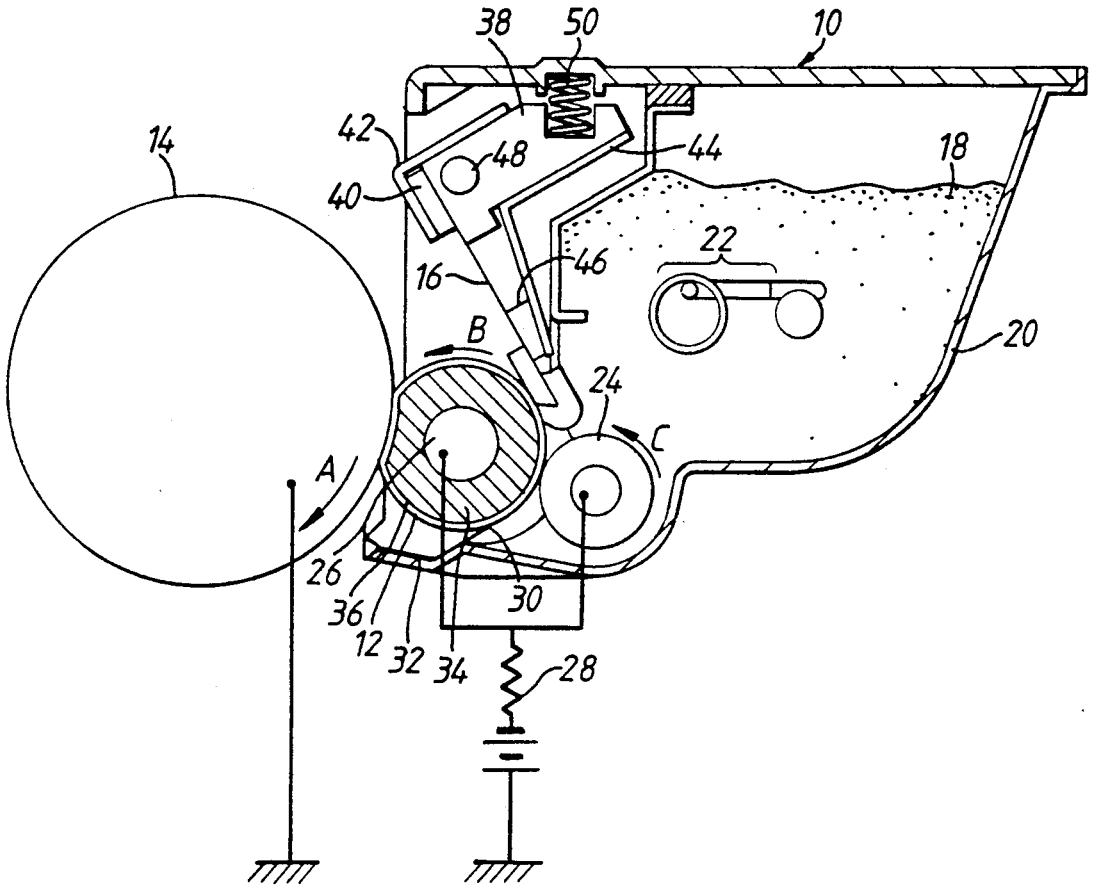
FIG. 1 is a cross-sectional view illustrating a developing device according to the present invention.

With reference to FIG. 1, an image forming apparatus in accordance with the present invention will now be described. The apparatus comprises a developing device 10 which includes a developing roller 12. Developing roller 12 is positioned to face an image bearing member 14, such as a photosensitive body. Image bearing member 14 is drum-shape in construction and is formed of an organic photoconductor (OPC) material. Member 14 has a drum diameter of 40 mm and is rotated by an electric motor (not shown) in the direction of arrow A. Developing roller 12 is brought into contact with a blade 16 for forming a layer of developing agent on the surface of developing roller 12. Blade 16 applies a uniform pressure against the surface of developing roller 12, thus making the thickness of the developing agent layer constant.

According to the present embodiment, developing device 10 is a contact-type one-component non-magnetic developing device. Developing roller 12 is made of a material having elasticity and electrical conductivity characteristics. The developing agent used in the developing device is a one-component non-magnetic toner 18. Since toner 18 does not need a carrier, a magnet roller or means for controlling toner density, the size and manufacturing cost of the developing device may be reduced.

Before describing the structure of developing apparatus 10, the developing process using developing roller 12 will be described.

With reference again to FIG. 1, toner 18 within a toner container 20 is stirred by a mixer 22 and is supplied to a toner supply roller 24 which is rotated in the direction of arrow C. After toner 18 is supplied to developing roller 12 by means of toner supply roller 24, toner 18 is frictionally charged by the surface of developing roller 12. Toner 18, thus, electrostatically adheres to the surface of developing roller 12 and is transferred. The quantity of toner 18 is limited by blade 16. In addition, the frictional charge of toner 18 is effected by the friction between developing roller 12 and blade 16.

According to the present embodiment, a reverse developing method is employed using an organic photosensitive drum as image bearing member 14. Moreover, image bearing member 14 is negatively charged. Accordingly, a negatively charged toner is used as toner 18. Thus, blade 16 is formed of a material which makes toner 18 easily susceptible to a negative charge. The surface potential of image bearing member 14 is set, for example, at −500 V, while the developing bias voltage is set, for example, at −200 V. The developing bias is supplied to a metallic shaft 26 of developing roller 12 through a protection resistor 28.

Figure 6:
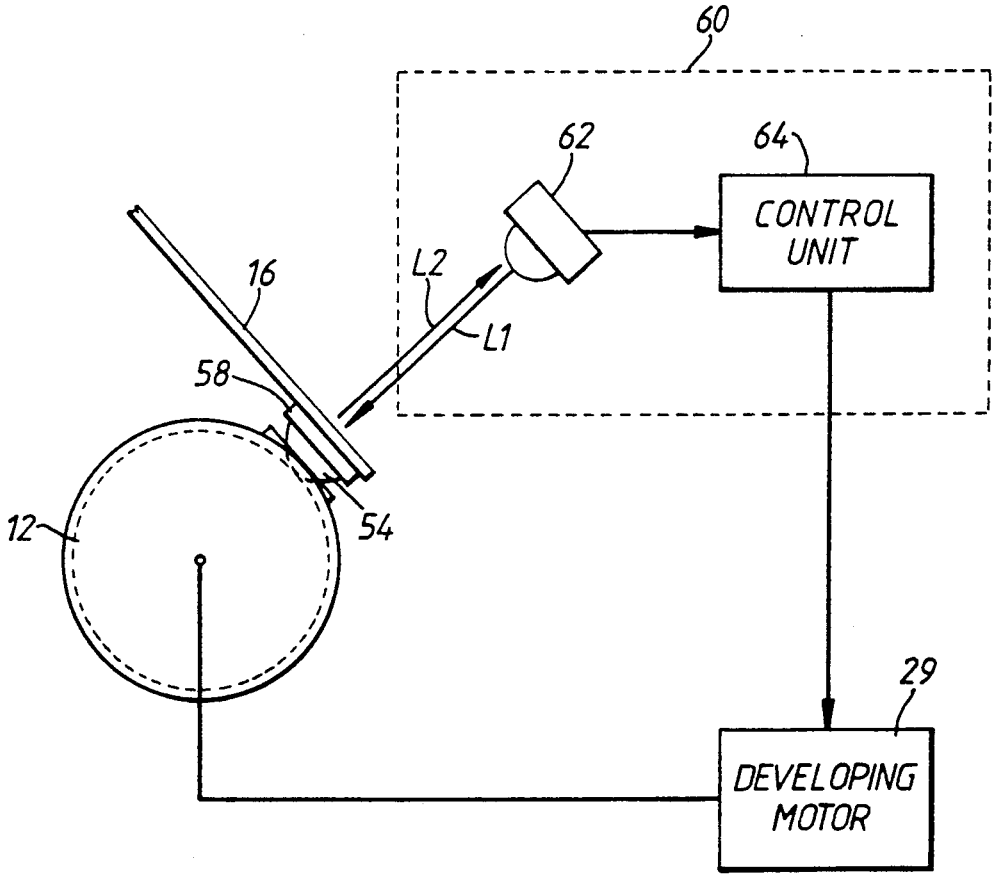
FIG. 6 is a block diagram illustrating a control device of the developing device of the present invention.
Figure 5A:
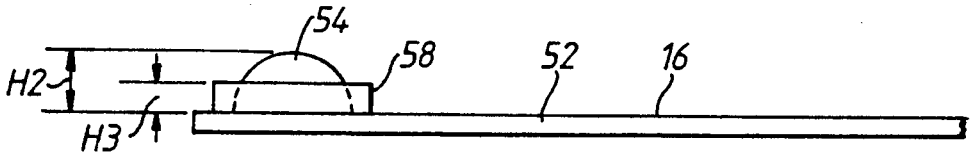
FIG. 5(*a*) to 5(*d*) are sectional views of different control members of the blade illustrated in FIG. 2.
Figure 5B:
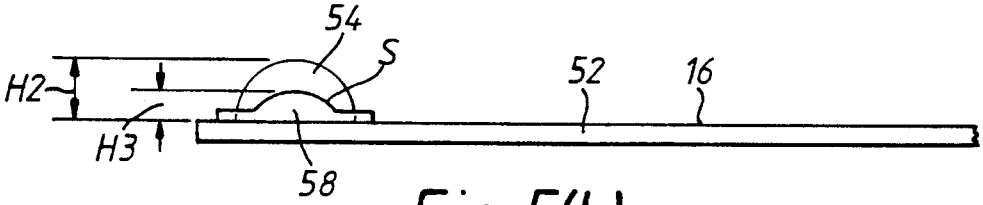
Figure 5C:
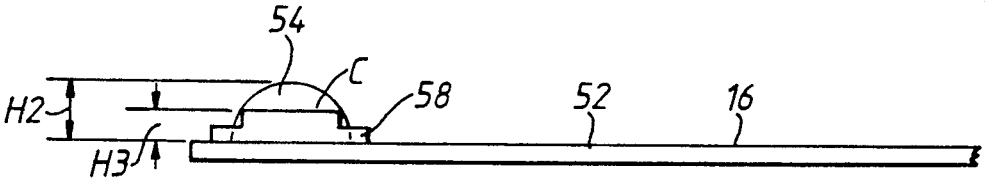
Figure 5D:
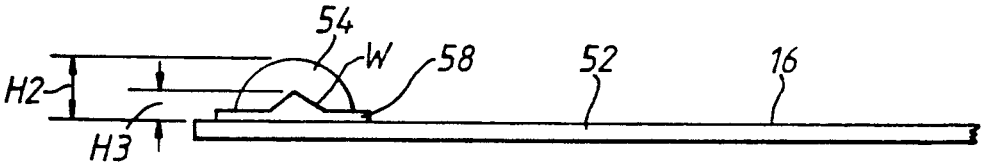

Developing roller 12 is rotated in the direction of arrow B by a developing motor 29 as shown in FIG. 6 at about 1 to 4 times the circumferential speed of image bearing member 14 while it is in contact with image bearing member 14 and with a contact width of about 1 to 5 mm between developing roller 12 and image bearing member 14. Toner 18 is sufficiently charged by friction at the position at which developing roller 12 is brought into contact with blade 16. Furthermore, toner 18 is charged at the position at which developing roller 12 is brought into contact with image bearing member 14. Thereby, a sharp image with an extremely small degree of fog may be obtained on the surface of image bearing member 14. Any access toner remaining after the developing process is scraped away by a recovery blade 30 formed of a Mylar film. The excess toner is returned to toner supply roller 24. Also, the toner is fused and adherent onto a shutting member 32 for containing the remaining toner after the developing process. Shutting member 32 is made of a plasticizer or the like. Even if developing device 10 is vertically inverted, toner 18 is prevented from escaping from developing device 10.

The details of developing roller 12 will now be described.

Figure 2:
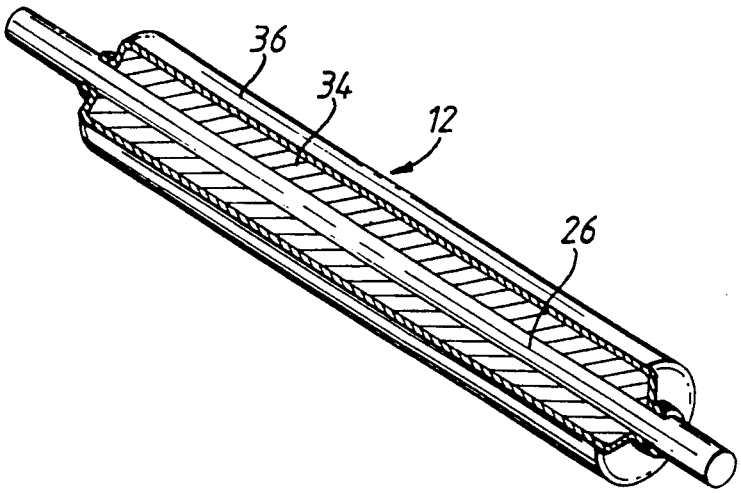
FIG. 2 is a perspective cross-sectional view illustrating the developing roller shown in FIG. 1.

The most important characteristics of developing roller 12 are electrical conductivity and elasticity. According to the present embodiment, and as shown in FIG. 2, developing roller 12 includes metallic shaft 26, an elastic layer 34 surrounding metallic shaft 26 and a conductive surface layer 36 surrounding elastic layer 34. Thereby, developing roller 12 has good electrical conductivity and elasticity characteristics. Also, this construction provides a smoother surface for developing roller 12 than is possible with other constructions. This increased smoothness allows the toner to be firmly contacted to, and correctly transferred by, the surface of developing roller 12.

Elastic layer 34 is made of an electrically conductive elastic rubber having a rubber hardness of 25 to 35 as measured by an A-type hardness meter in accordance with the JISK6301 standard specification, for example, silicon rubber, urethane rubber, diene rubber or etylene-propylene-diene terpolymer (EPDM) rubber. This is because elastic layer 34 compensates for any peeling or scarring of conductive surface layer 36.

Also, conductive surface layer 36 is formed by coating, for example, a mixture of urethane resin with 10 to 30 weight-percent of a conductive carbon. Since conductive surface layer 36 comes into direct contact with toner 18 and the surface of image bearing member 14, conductive surface layer 36 must be prevented from contaminating toner 18 and image bearing member 14 due to oxidation of the plasticizer, curing agents, process oils, etc. It is desirable that the smoothness of the surface of conductive surface layer 36 be 3 μmRz or less. This is a standard smoothness measurement unit used in Japan, and is defined by the JISK6301 standard specification. If the smoothness of the surface of conductive surface layer 36 is higher than such a value, imperfections along the surface of elastic layer 34 may appear on the image.

Referring to FIG. 1 and FIGS. 3 to 5, the details of blade 16 will now be explained.

Figure 3:
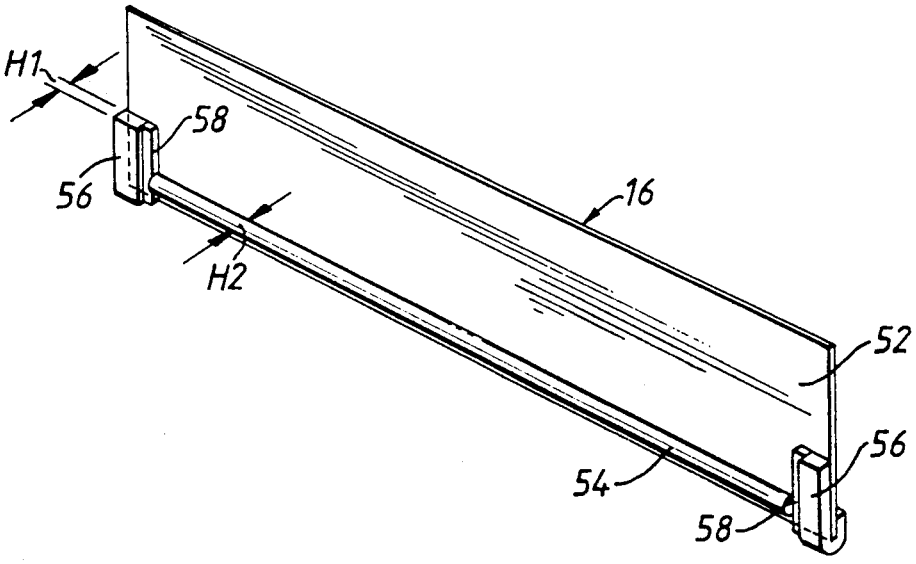
FIG. 3 is a perspective view illustrating the blade shown in FIG. 1.

Blade 16 is supported by a first blade holder 38, a spacer 40 and a second blade holder 42. A baffle plate 44 is attached to first blade holder 38. Baffle plate 44 is attached to the rear surface of blade 16 through a foamed material member 46, such as Mortprene. Such a structure prevents penetration of toner 18 and vibration of blade 16. A rotational shaft 48 of first blade holder 38 and a plurality of compression springs 50 press blade 16 onto the surface of developing roller 12. Blade 16 has a thin spring plate 52 as shown in FIG. 3. Thin spring plate 52 is made of, for example, stainless steel, beryllium cooper, phosphor bronze or the like. The spring constant of compression spring 50 is lower than the spring constant of the thin spring plate of blade 16. Thus, the pressing force of compression spring 50 varies little even if the contact portion of blade 16 with the surface of developing roller 12 becomes worn. Thus, a desirable toner layer may be consistently formed many times.

As shown in FIG. 3, blade 16 includes a cylindrical tip 54 which is brought into contact with the surface of developing roller 12 and a seal member 56 for sealing toner 18. Tip 54 is mounted along the longitudinal direction on the leading edge of thin spring plate 52 and is made of an elastic member, for example silicon rubber, silicon resin, urethane rubber or urethane resin, with a JIS-A hardness of about 30–85.

Seal member 56 is attached to each end of thin spring plate 52 and is formed of urethane foam or the like. The height H1 of seal member 56 is higher than or equal to the height H2 of tip 54. Also, the hardness of seal member 56 is softer than the hardness of tip 54. Thus, the position of the leading edges of seal member 56 project further towards developing roller 12 than the leading edge of tip 54. Thereby, the escape of toner 18 from the ends of blade 16 may be reliably prevented when tip 54 is pressed against the surface of developing roller 12.

Figure 4:
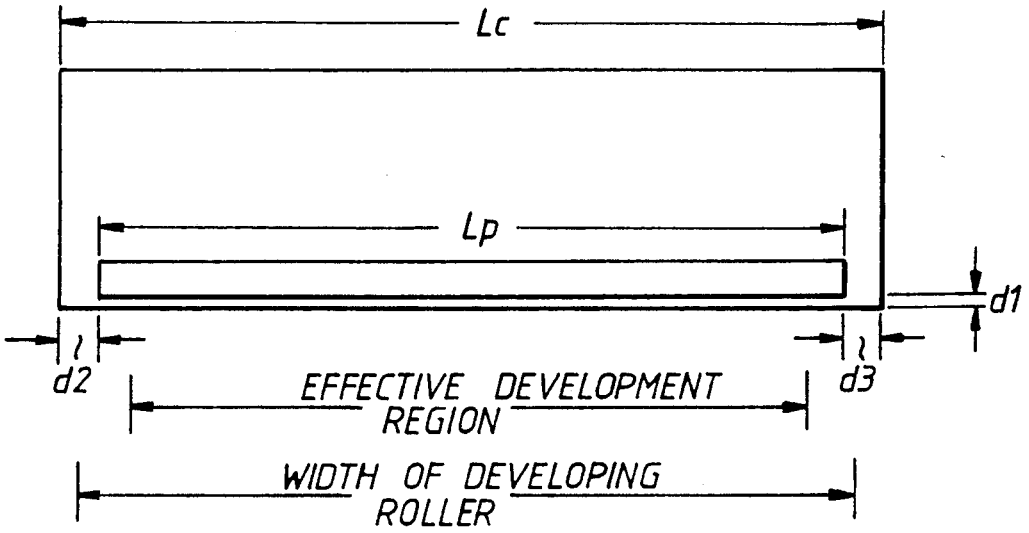
FIG. 4 is a front view of the blade illustrated in FIG. 3.

As shown in FIG. 4, cylindrical tip 54 is mounted in a position in which tip 54 is separated from the leading edge of thin spring plate 52 by length d1. The leading edge portion of thin spring plate 52 is used for pressing and positioning when tip 54 is mounted to thin spring plate 52. Thereby, the positioning accuracy in the tangential direction between developing roll 12 and tip 54 may be improved. Also, when length d1 is too large, a uniform toner layer may not be formed on the surface of developing roller 12 due to pressure by the toner flow. Therefore, it is desirable that the length d1 be about 0.5–5 mm, and preferably about 0.5–2 mm. Also, seal members 56*a* and 56*b* are bonded on the portions at both ends in the longitudinal direction of thin spring plate 52 where tip 54 is not mounted. The length Lp of tip 54 in the longitudinal direction is shorter than the length Lc of thin spring plate 52 by the dimension (d2+d3). When taking into account sealability, the dimension (d2+d3) requires a minimum of about 3 mm at each end. When the dimension (d2+d3) is too long, developing device 10 becomes larger. Thus, it is desirable that the dimension (d2+d3) be about 6–30 mm, and preferably about 6–20 mm. The length Lp of tip 54 is longer than the width of the effective development region. The length Lc of thin spring plate 52 is equal to the width of developing roller 12.

Also, blade 16 has a control member 58 for controlling the amount of the contact pressure of blade 16 on developing roller 12 as shown in FIG. 3. Control member 58 is mounted on thin spring plate 52 and is positioned to each end of tip 54 and the inside of seal member 56. Control member 58 is made of an elastic member, for example, urethane rubber, silicon rubber, urethane resin, silicon resin or the like.

Control member 58 is formed of a flat plate member as shown in FIG. 5(*a*). In the present embodiment, the height H3 of control member 58 is lower than the height H2 of tip 54. The hardness of control member 58 is equal to or harder than that of tip 54.

Also as shown in FIGS. 5(*b*) to 5(*d*), in another embodiment of control member 58, control member 58 is formed of a member having a semicircular portion S (FIG. 5(*b*)), a member having a convex portion C (FIG. 5(*c*)) or a member having a wedge-shaped portion W (FIG. 5(*d*)).

As described above, in the present embodiment, the height H3 of control member 58 is lower than the height H2 of tip 54. Thus, the following test was performed in order to determine the difference between these heights.

In the test, the relationship between the distortion of developing roller 12 and the quality of the image was investigated when developing roller 12 was brought into contact with blade 16 for a prescribed period of time. The conditions and contact pressure of developing roller 12 and blade 16 were as follows:

Developing roller 12

Elastic layer 34;

Conductive urethane rubber having a hardness of 35° as measured by the A-type hardness meter in accordance with the JISK6301 standard.

Conductive surface layer 36;

A mixture of urethane resin with 20 weight-percent of a conductive carbon

Blade 16

Thin spring plate 52;

Phosphor bronze having a thickness of 0.15 mm.

Tip 54;

Silicon rubber having a hardness of 80° as measured by the A-type hardness meter in accordance with the JISK6301 standard and having a radius of 1.5 mm.

Seal member 56;

Urethane foam having a hardness of 10° as measured by the A-type hardness meter in accordance with the JISK6301 standard.

Control member 58 standard;

Urethane rubber having a hardness of 96° as measured by the A-type hardness meter in accordance with the JISK6301 standard.

Pressing load; 70 g/cm

Test Time; 7 days

Table 1, as shown below, indicates the results of the test.

TABLE 1

| The distortion of developing roller 12 (μm) | Quality of image |
|---|---|
| 10 | Good |
| 50 | Good |
| 100 | Good |
| 150 | Good |
| 200 | Normal |
| 250 | Poor |

In this test, where the distortion of developing roller 12 was 200 μm or more, the image was of low quality, e.g., non-uniform. However, where the distortion of developing roller 12 was 200 μm or less, the image was of high quality. Also, where tip 54 was made of silicon rubber, the height H2 of tip 54 varies in accordance with the wearing of tip 54. Therefore, in this test, the height H3 of control member 58 was dependent on the amount of the frictional wear of tip 54. Thus, the height H3 of control member 58 may be determined using the following equation (1);

$$Gh <= R - (Ch + Ch \times Cv) \quad (1)$$

where

Gh: the difference between the height of control member 58 and the height of tip 54 (μm);

R: the amount of the distortion of developing roller 12 when the quality of the image is normal (μm);

Ch: the change in the height of tip 54 due to the frictional wear (μm); and

Cv: the correction value of the error

In the above-described test, R was 200 (μm), Ch was 70 (μm) and Cv was 0.2. Thus, Gh was 116 (μm) or less. Therefore, in the present embodiment, the difference between the height H3 of control member 58 and the height H2 of tip 54 (Gh) is determined to be 100 (μm).

The difference between the height H3 of control member 58 and the height H2 of tip 54 (Gh) may change with the construction and materials used for developing roller 12 and blade 16.

The relationship between the hardness of tip 54 and the hardness of control member 58 also was investigated. In this investigation, the conditions of contact pressing of developing roller 12 and blade 16 were as follows:

Developing roller 12

Elastic layer 34;

Conductive urethane rubber having a hardness of 35° as measured by the A-type hardness meter in accordance with the JISK6301 standard Conductive surface layer 36;

A mixture of urethane resin with 20 weight-percent of a conductive carbon

Blade 16

Thin spring plate 52;

Phosphor bronze having a thickness of 0.15 mm.

Tip 54;

Silicon rubber having a hardness of 80° as measured by the A-type hardness meter in accordance with the JISK6301 standard and having a radius of 1.5 mm.

Seal member 56;

Urethane foam having a hardness of 10° as measured by the A-type hardness meter in accordance with the JISK6301 standard.

Control member 58;

Urethane rubber having a hardness of 60°, 70°, 80° and 90° as measured by the A-type hardness meter in accordance with the JISK6301 standard.

Pressing load; 70 g/cm

Test time; 7 days

Table 2, as shown below, indicates the results of this test.

TABLE 2

| The hardness of control member 58 | Quality of image |
|---|---|
| 60° | Poor |
| 70° | Poor |
| 80° | Good |
| 90° | Good |

In the above investigation, where the hardness was 60° or 70°, the image was of low quality, e.g., density randomness. Where the hardness of control member 58 was softer than that of tip 54, the deformation of contact member 58 became large due to a long standing time. Thus, the distortion of tip 54 increased. Therefore, where contact member 58 had a hardness of 60° or 70°, the image was of low quality.

However, where the hardness was 80° or 90°, the image was of high quality.

As a result of this investigation, it was recognized that the hardness of control member 58 was equal to or harder than that of tip 54 in order to obtain a high-quality image.

Referring to FIG. 6, developing device 10 also has a control device 60 for controlling the distortion of the surface of developing roller 12.

Control device 60 includes an optical sensor 62 for measuring the distance between blade 16 and optical sensor 62 and a control unit 64 for controlling the operation of developing motor 29 based on the distance detected by optical sensor 62. Optical sensor 62 radiates a light L1 on blade 16 and detects the light L2 reflected from blade 16. Thereby, optical sensor 62 measures the distance between blade 16 and optical sensor 62. Control unit 64 obtains the amount of the distortion of the surface of developing roller 12 based on the distance detected by sensor 62. Control unit 64 supplies a control signal to developing motor 29 for rotating developing roller 12 when the amount of the distortion is 200 μm or more. Developing motor 29 rotates developing roller 12 in response to the control signal supplied from control unit 64. In this case, control unit 64 determines the rotational angle of developing roller 12 so as not to bring the distorted portion of the surface of developing roller 12 into contact again with image bearing member 14 or blade 16. In this embodiment, developing motor 29 turns developing roller 12 at about 30 degrees.

The quality of the toner image was checked with respect to embodiments 1, 2 and 3 with the following developing conditions;

Exposed portion potential; −80 V

Unexposed portion potential; −500 V

Developing bias voltage; −200 V

Contact width of developing; 1.5 mm roller 12 and image bearing member 14

Embodiments 1 and 2, respectively, were a developing device in accordance with the present invention. Embodiment 1 was the developing device having control member 58 and control device 60 and embodiment 2 was the developing device having control member 58 and no control device 60. Embodiment 3 was a developing device including no control member 58 and no control device 60.

Figure 7:
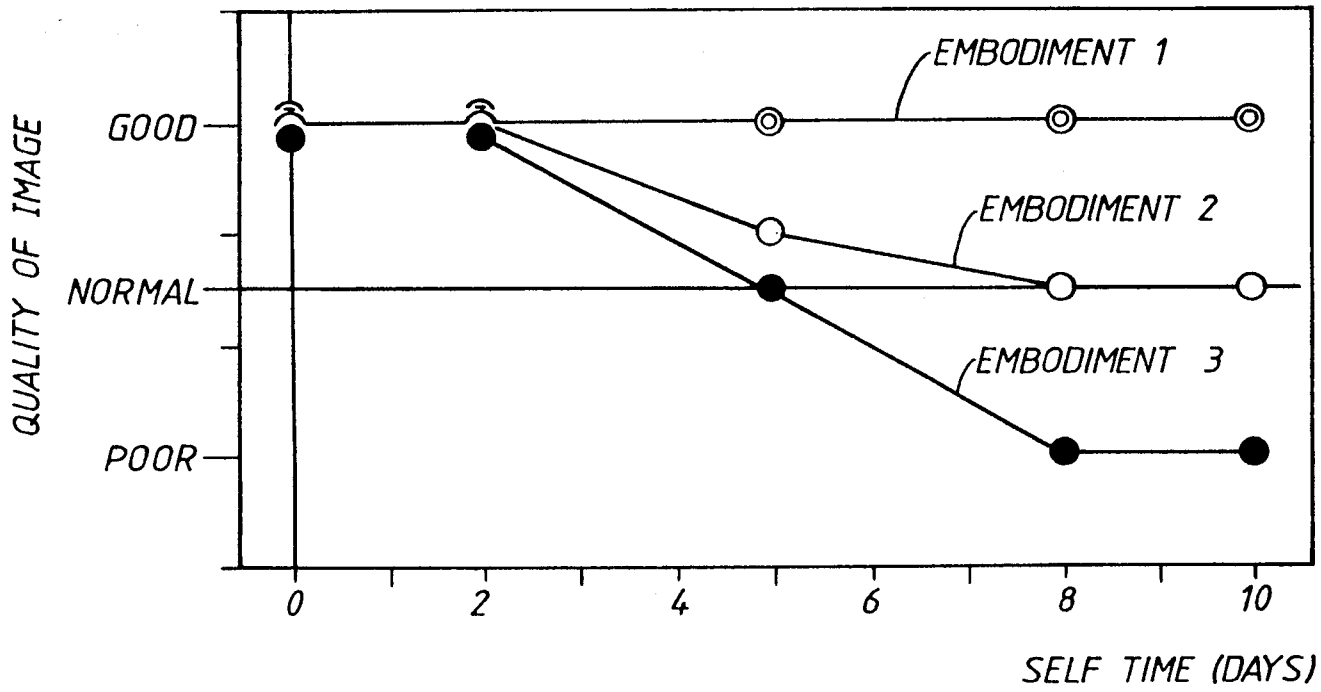
FIG. 7 is a graph showing the relationship between the quality of the reproduced image over time.

FIG. 7 shows the quality of the toner image under embodiments 1, 2 and 3, respectively, when allowed to stand (0, 2, 4, 6, 8 and 10 days). Referring now to FIG. 7, in embodiments 1 and 2, the toner image was of high quality after the test period of 6, 8 and 10 days. With respect to embodiment 1, the toner image was excellent after the test period of 10 days. However, in embodiment 3, the toner image was of low quality after the test period of 8 or 10 days.

Also, in embodiments 1 and 2, the result of carrying out a 10,000 sheets life test concluded that excellent quality images, equivalent to the initial images, could still be obtained.

Thus, it was apparent that the developing device of the present invention is capable of consistently producing high-quality images, wherein the image quality is not deteriorated even when the developing device is set or used in the image forming apparatus for a long period of time.

It should be understood that the detailed description and examples, which indicating presently preferred embodiments of this invention, are given by way of illustration only. Various modifications and changes may be made to the present invention, without departing from the scope or spirit of the invention, as set forth in the following claims.

We claim:

1. A device for developing a latent image formed on an image bearing member, said device comprising:

roller means for supplying a developing agent to said image bearing member, said roller means having an elastic member for providing a predetermined width between said roller means and said image bearing member;

forming means for forming a layer of said developing agent on said roller means, said forming means having a plate member, contact means mounted in the longitudinal direction along the leading edge of said plate member for contacting the surface of said roller means so as to form said layer and pressing means for pressing said contact means against said roller means at a predetermined pressure; and control means positioned adjacent each end of said contact means and mounted on said plate member for controlling the amount of said predetermined pressure, the vertical height of said control means being lower than the vertical height of said contact means.

2. The device of claim 1, wherein the difference between the vertical height of said control means and the vertical height of said contact member is determined in accordance with the following relationship;

$$Gh <= R - (Ch + Ch\ Cv)$$

wherein

Gh: the difference between the vertical height of said control means and the vertical height of said contact means;

R: the amount of the distortion of the roller means;

Ch: the change in the vertical height of said contact means due to friction wear; and Cv: the correction value of the error.

3. A device for developing a latent image formed on an image bearing member, said device comprising:

roller means for supplying a developing agent to said image bearing member, said roller means having an elastic member for providing a predetermined width between said roller means and said image bearing member;

forming means for forming a layer of said developing agent on said roller means, said forming means having a contact member in pressure contact with the surface of said roller means for forming said layer of said developing agent and pressing means for pressing said contact member to said roller means;

a control member for controlling the amount of said pressure contact of said contacting member to said roller means;

means for measuring the amount of distortion of any distorted portion of the surface of said roller means when said roller means is in contact with said contact member;

rotating means for rotating said roller means at a predetermined rotational angle when the amount of the distortion measured by said measuring means exceeds a predetermined value; and control means for controlling said rotating means, said controlling means including rotational angle changing means for changing the rotational angle of said roller means so that any distorted portion of the surface of said means for determining the rotational angle of said roller means does not come into contact with said image bearing member and said contact member.

4. A device for developing a latent image formed on an image bearing member, said device comprising:

roller means for supplying a developing agent to said image bearing member, said roller means having an elastic member for providing a predetermined width between said roller means and said image bearing member;

forming means for forming a layer of said developing agent on said roller means, said forming means having a contact member in pressure contact with the surface of said roller means for forming said layer of said developing agent and pressing means for pressing said contact member to said roller means;

a control member for controlling the amount of said pressure contact of said contacting member to said roller means;

measuring means for measuring the amount of distortion of any distorted portion of the surface of said roller means when said roller means is in contact with said contact member, said measuring means including an optical sensing means for detecting reflected light from said forming means, said reflected light being used to measure the amount of the distortion of the surface of said roller means; and rotating means for rotating said roller means at a predetermined rotational angle when the amount of the distortion measured by said measuring means exceeds a predetermined value.

5. A device for developing a latent image formed on an image bearing member, said device comprising:

roller means for supplying a developing agent to said image bearing member, said roller means having an elastic member for providing a predetermined width between said roller means and said image bearing member;

forming means for forming a layer of said developing agent on said roller means, said forming means having a plate member, a contact member in pressure contact with the surface of said roller means and mounted in the longitudinal direction along the leading edge of said plate member for forming said layer of said developing agent and pressing means for pressing said contact member to said roller means;

a control member, mounted on said plate member and positioned adjacent each end of said contact member, for controlling the amount of said pressure contact of said contacting member to said roller means, the height of said control member being lower than the height of said contact member;

means for measuring the amount of distortion of any distorted portion of the surface of said roller means when said roller means is in contact with said contact member; and rotating means for rotating said roller means at a predetermined rotational angle when the amount of the distortion measured by said measuring means exceeds a predetermined value.

6. An image forming apparatus comprising;

latent image forming means for forming a latent image on an image bearing member;

developing roller means for supplying a one-component non-magnetic developing agent to said image bearing member so as to develop the latent image formed on said image bearing member, said developing roller means having an elastic layer for providing a predetermined width between said developing roller means and said image bearing member and a conductive layer deposited on the elastic layer;

blade means for forming a layer of the one-component non-magnetic developing agent on said developing roller means, said blade means having a plate member which includes an elastic tip member attached in the longitudinal direction along the leading edge of said plate member for contacting the surface of said developing roller means in order to form the layer of the developing agent;

a pressing member for pressing said elastic tip member to said developing roller means at a predetermined pressure;

an elastic control member attached on the plate member and positioned to each end of said tip member for controlling the amount of said predetermined pressure;

wherein the height of said elastic control member being lower than the height of said elastic tip member and the hardness of the surface of said elastic control member being equal to or harder than the hardness of the surface of said elastic tip member.

7. The device of claim 6, wherein the blade means includes an elastic seal member attached to each end of said plate member; said elastic seal member being positioned to the outside of said elastic control member for preventing escape of the developing agent from the end portions of said blade means; and wherein the height of said seal member is higher than or equal to the height of said tip member and the hardness of the surface of said seal member is less than the hardness of the surface of said tip member.

* * * * *